US009573170B2

(12) United States Patent
Ponomarev

(10) Patent No.: US 9,573,170 B2
(45) **Date of Patent: *Feb. 21, 2017**

(54) METHOD OF MANUFACTURING A VACUUM STEAM CLEANING APPARATUS

(71) Applicant: The Boeing Company, Chicago, IL (US)

(72) Inventor: Sergey G. Ponomarev, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 291 days.

This patent is subject to a terminal disclaimer.

(21) Appl. No.: 14/313,801

(22) Filed: Jun. 24, 2014

(65) Prior Publication Data

US 2014/0304969 A1 Oct. 16, 2014

Related U.S. Application Data

(63) Continuation of application No. 13/283,250, filed on Oct. 27, 2011, now Pat. No. 8,790,467.

(51) Int. Cl.
*B08B 3/00* (2006.01)
*B08B 5/04* (2006.01)

(52) U.S. Cl.
CPC . *B08B 3/00* (2013.01); *B08B 5/04* (2013.01); *B08B 2230/01* (2013.01); *Y10T 29/49826* (2015.01)

(58) Field of Classification Search
CPC ..... A47L 11/34; A47L 11/38; A47L 11/408; A47L 11/4038; A47L 11/4088; A47L 1/02; A47L 1/08; B21D 39/03; B08B 3/00; B08B 5/00
USPC ..... 15/302, 320, 345; 29/428
See application file for complete search history.

(56) References Cited

U.S. PATENT DOCUMENTS 2,497,435 A 2/1950 Branneman
3,439,374 A 4/1969 Wisdom
3,959,010 A * 5/1976 Thompson ..... E01H 1/103 134/10

(Continued)

FOREIGN PATENT DOCUMENTS

JP H4106690 2/1991
JP 200163709 3/2001

(Continued)

OTHER PUBLICATIONS

Healthgoods LLC, "Reliable Enviromate Tandem EV1 Vapor Vacuum Steam Cleaner System", available at <http://www.healthgoods.com/Reliable_Enviromate_EV1_Vapor_Vacuum_Steam_Cleaner_p/re-tandemev1.htm>, last visited Aug. 30, 2011.

(Continued)

*Primary Examiner* — Saeed T Chaudhry

(57) ABSTRACT

A method of manufacturing a cleaning apparatus may include forming a plurality of apertures in an inner wall of a cleaning head having an annular steam chamber open at a lower edge and enclosing a vacuum chamber. The apertures may fluidly couple the annular steam chamber to the vacuum chamber. The method may include locating the plurality of apertures in vertically spaced relation to the lower edge of the cleaning head. The method may additionally include providing a steam nozzle fluidly coupled to the annular steam chamber.

20 Claims, 11 Drawing Sheets

(56) References Cited

U.S. PATENT DOCUMENTS

| | | | |
|---|---|---|---|
| 5,502,872 | A | 4/1996 | Chae et al. |
| 5,607,349 | A | 3/1997 | Karubian et al. |
| 5,613,271 | A | 3/1997 | Thomas |
| 6,311,365 | B1 | 11/2001 | Dornier |
| 2003/0233726 | A1 | 12/2003 | Murray |
| 2010/0018552 | A1 | 1/2010 | Kokubo |

FOREIGN PATENT DOCUMENTS

| | | |
|---|---|---|
| JP | 201034203 | 7/2008 |
| ZA | 9503212 | 1/1996 |

OTHER PUBLICATIONS

Dupray Industries, "Carmen Super Inox Steam Cleaner", available at <http://www.dupray.ca/steam-cleaning-equipment/carmen-super-inox-steam-cleaner/>, last visited Aug. 30, 2011.

Just Renew-It, "Super Vapor 6 with Vacuum Extractor", available at <http://refreshyourhome.com/new-steamer-windows/Vapor6-Steam-Cleaners-VAC.html>, last visited Aug. 30, 2011.

Wikipedia, "Vapor Steam Cleaner", available at < http://en.wikipedia.org/wiki/Vapor_Steam_Cleaners>, last visited Aug. 30, 2011.

Daimer Industries, "KleenJet Ultra 5000CV Commercial / Industrial Grade steam cleaner", available at <http://www.daimer.com/steam-cleaners/kleenjet-5000cv.htm>, last visited Aug. 30, 2011.

Helium_Where Knowledge Rules, "How steam cleaning works", available at <http://www.helium.com/items/1341724-how-a-steam-cleaner-works-steam-cleaning-step-by-step-steam-cleaning>, last visited Aug. 30, 2011.

Durr, "EcoCSteam Cleaning Process," available at <http://www.durr-ecoclean.com/products/>, last visited Oct. 27, 2011.

PCT/US2012/047152, International Search Report dated Oct. 5, 2012.

Japanese Office Action for JP2014-538786, dated May 24, 2016.

* cited by examiner

METHOD OF MANUFACTURING A VACUUM STEAM CLEANING APPARATUS

FIELD

The present disclosure relates generally to cleaning devices and, more particularly, to vacuum devices employing steam for cleaning.

BACKGROUND

Conventional methods for removing debris or contamination from articles or surfaces include the use of a cloth for hand wiping the article or surface. For certain types of debris, conventional cleaning methods include the use of a cleaning substance applied to the cloth to expedite removal of the debris during the hand wiping operation. Unfortunately, for certain cleaning substances, it is recommended to avoid contact with the cleaning substance and the vapors emitted by the cleaning substance. The recommendation to avoid such vapors may be important when the cleaning operation is performed in a confined space.

In consideration of the desire to avoid contact with conventional cleaning substances and their vapors, aqueous based cleaning fluids have been introduced. Although generally satisfactory in reducing undesirable vapor emissions, aqueous-based cleaning fluids have certain limitations that detract from their overall utility. For example, although the use of aqueous-based cleaning fluids may generally be effective for cleaning flat surfaces by hand wiping, the cleaning of three-dimensional objects presents several challenges.

For example, during certain manufacturing operations such as when drilling a fastener hole through a structure, lubrication may be used to reduce friction. After installing the fastener, it may be necessary to remove the lubrication on the fastener and on the mounting surface surrounding the fastener in order to achieve a relatively high level of cleanliness. Unfortunately, due to the complex three-dimensional geometry associated with certain fasteners, removal of the lubrication from the fastener and the surrounding area may be difficult. Although the use of aqueous based cleaning fluids may facilitate the removal of lubrication from generally flat areas in a hand wiping operation, complete removal of lubrication from the complex geometry of a fastener may be difficult.

As can be seen, there exists a need in the art for a system and method for cleaning three dimensional articles to a high level of cleanliness. Preferably, such system and method may be provided in a healthy and safe manner.

SUMMARY

The above-noted needs associated with cleaning systems are specifically addressed and alleviated by the present disclosure which, in an embodiment, provides an apparatus having a cleaning head for cleaning an article. The cleaning head may have a lower edge and may include an annular steam chamber and a steam nozzle. The annular steam chamber may define a vacuum chamber that may be configured to receive the article therewithin. The annular steam chamber may have a plurality of discrete apertures positioned in vertically spaced relation to the lower edge. The steam nozzle may be configured to provide steam to the annular steam chamber for discharge through the apertures into the vacuum chamber.

In a further embodiment, disclosed is a vacuum steam cleaning system having a housing which may include a vacuum source and a steam source. The vacuum steam cleaning system may further include a cleaning head having a lower edge. The cleaning head may be coupled to the vacuum source and the steam source. The cleaning head may include an annular steam chamber that may be open at the lower end and which may enclose a vacuum chamber. The vacuum chamber may be configured to receive the article. The annular steam chamber may have a plurality of discrete apertures positioned in vertically spaced relation to the lower edge for discharge of steam through the apertures into the vacuum chamber. The cleaning head may additionally include a nozzle having a nozzle main outlet configured to discharge steam directly into the vacuum chamber. The lower edge of the cleaning head may be configured such that the vacuum chamber is maintainable in substantially sealed engagement with the mounting surface when steam is provided to the vacuum chamber.

Also disclosed is a method of cleaning an article that may comprise covering the article with an annular steam chamber having a lower edge and a plurality of discrete apertures. The apertures may be positioned in vertically spaced relation to the lower edge. The method may further include discharging steam through the apertures and into a vacuum chamber. The method may additionally include suctioning debris and steam out of the vacuum chamber.

In addition, disclosed is a method of manufacturing a cleaning apparatus. The manufacturing method may include forming a plurality of apertures in an inner wall of a cleaning head having an annular steam chamber open at a lower edge and enclosing a vacuum chamber. The apertures may fluidly couple the annular steam chamber to the vacuum chamber. The method may include locating the plurality of apertures in vertically spaced relation to the lower edge of the cleaning head. The method may additionally include providing a steam nozzle fluidly coupled to the annular steam chamber. The method may also include fluidly coupling an upper end of the annular steam chamber to a steam nozzle, and fluidly coupling at least one nozzle main outlet to the steam nozzle.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present disclosure will become more apparent upon reference to the drawings wherein like numerals refer to like parts throughout and wherein.

DETAILED DESCRIPTION

Figure 1:
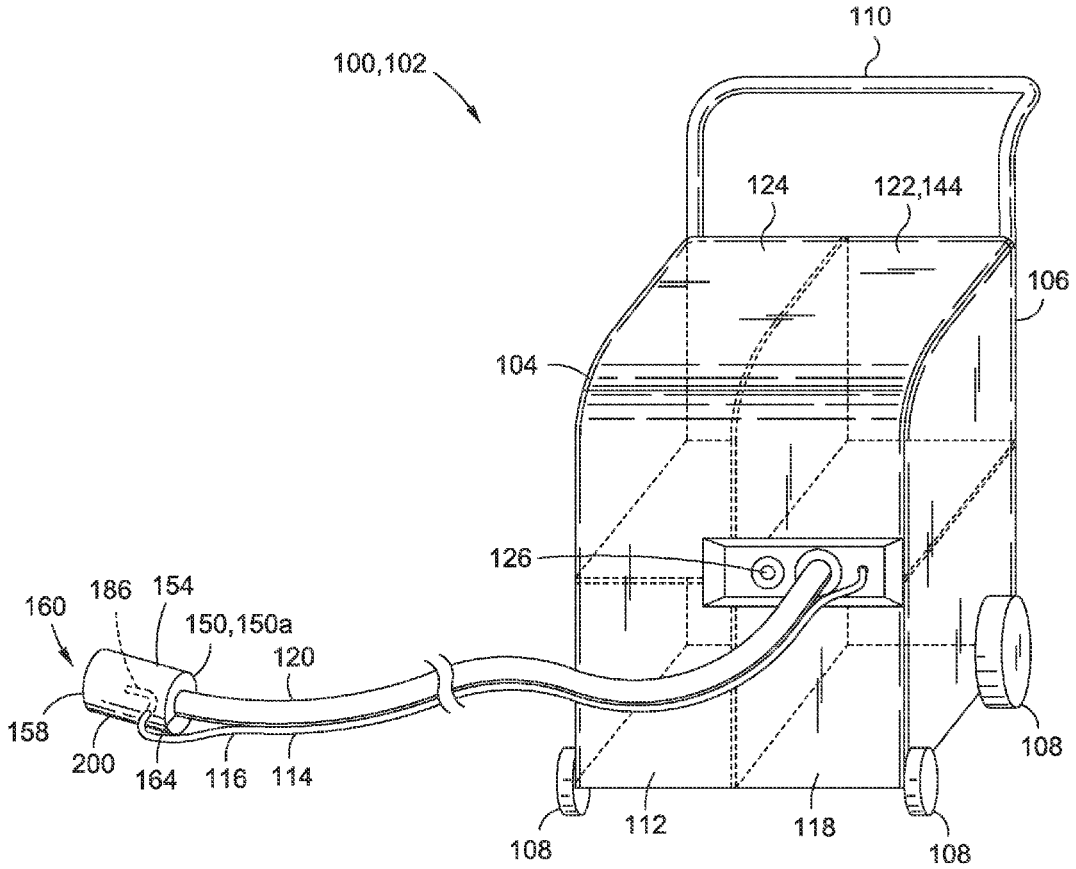
FIG. 1 is an illustration of an embodiment of a vacuum steam cleaning system including a housing containing a steam source and a vacuum source and wherein the housing may be fluidly coupled to a cleaning head for cleaning an article and/or mounting surface of the article.

Referring now to the drawings wherein the showings are for purposes of illustrating preferred and various embodiments of the disclosure, shown in FIG. 1 is an embodiment of a vacuum steam cleaning system 100 for cleaning one or more articles 250 including, but not limited to, complex three dimensional articles 250 and/or two-dimensional articles 250 such as the mounting surface 254 from which one or more articles 250 may protrude. The system 100 shown may include a housing 106 that may contain a steam source 112 and a vacuum source 118. The steam source 112 and vacuum source 118 may be fluidly coupled to a cleaning head 150 apparatus 102. The system 100 may also include a vacuum hose 120 fluidly coupling the vacuum source 118 to the cleaning head 150 such that vacuum suctioning 162 may be applied to the cleaning head 150. The system 100 may also include a steam hose 114 fluidly coupling the steam source 112 to the cleaning head 150 such that steam 184 may be provided to the cleaning head 150.

Figure 3:
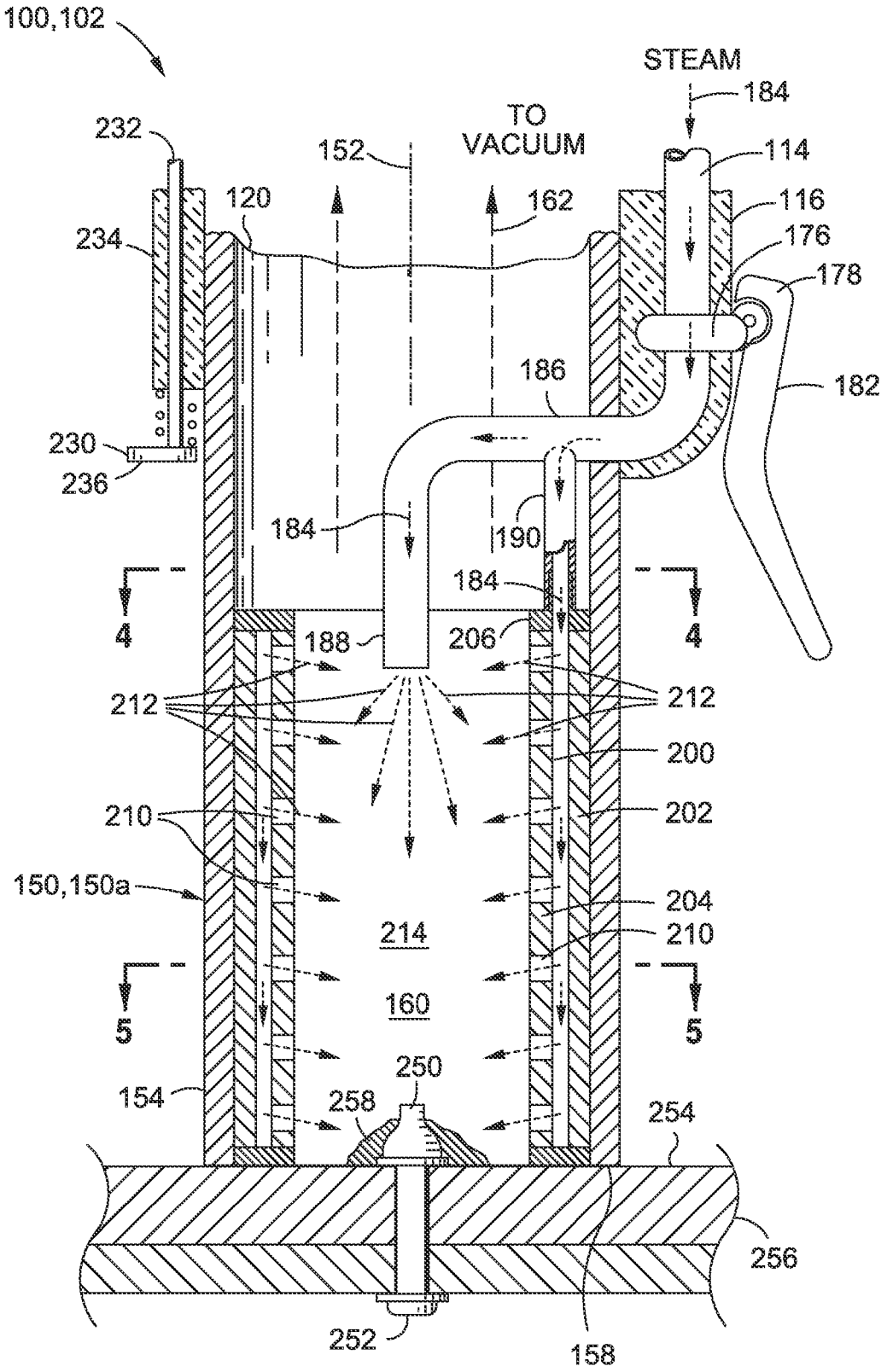
FIG. 3 is a cross sectional view of an embodiment of the cleaning head mounted over a fastener to be cleaned and further illustrating the discharge of steam into the vacuum chamber through a plurality of apertures formed in an inner wall of an annular steam chamber.

Referring briefly to FIG. 3, shown is a cleaning head 150 having a cylindrical shape 150*a* and which may include an annular steam chamber 200 enclosing a vacuum chamber 160 and receiving steam 184 from the steam hose 114. The annular steam chamber 200 may include one or more apertures 210 for discharging steam spray 212 into the vacuum chamber 160. The cleaning head 150 may also include a nozzle 186 fluidly coupled to the steam hose 114 and having a nozzle main outlet 188 that may be configured to discharge steam spray 212 directly into the vacuum chamber 160. The vacuum chamber 160 may be sized and configured to receive one or more articles 250 to be cleaned. Advantageously, the cleaning head 150 may be configured such that the steam spray 212 discharged from the apertures 210 and/or from the nozzle main outlet 188 results in the formation of a steam cloud 214 within the vacuum chamber 160. The steam cloud 214 may facilitate the removal of debris 258, contamination, and/or unwanted material from one or more articles 250 and/or from the mounting surface(s) 254 from which the articles 250 protrude.

The vacuum chamber 160 may be fluidly coupled to the vacuum hose 120 to provide vacuum suctioning 162 of the vacuum chamber 160. Advantageously, the cleaning head 150 is configured such that vacuum suctioning 162 and steam cleaning occur within a single three-dimensional spatial volume that is substantially sealed to a mounting surface 254. By containing the vacuum suctioning 162 and steam cleaning within a single volume, release of contaminated steam, debris particles 260 (FIG. 15B), water vapor, chemicals, detergents, and other materials into the surrounding environment is avoided. In this manner, the cleaning head 150 results in an improvement in the health and safety of the work environment.

Referring back to FIG. 1, the housing 106 may be mounted to or integrated with a portable cart 104 having wheels 108 and a handle 110 for transporting or moving the housing 106. The housing 106 may optionally be mounted to a vehicle (not shown) such that cleaning operations may be performed in the field or at remote locations. The housing 106 may be configured as a stationary system 100 mounted in a production, maintenance, or repair facility or in any one of a variety of other types of facilities, without limitation. The system 100 may be implemented as a manually operated standalone unit and/or as part of an automated machine. For example, the system 100 may be implemented in a robotic assembly 128 (FIGS. 12-13) for autonomously or semi-autonomously performing cleaning operations as described in greater detail below.

The housing 106 may be configured to house a steam source 112 including a water source (not shown) or water tank (not shown) and a heating mechanism (not shown) for generating steam 184 (FIG. 3) for delivery to the cleaning head 150 through the steam hose 114. The housing 106 may also include a vacuum source 118 as indicated above for providing vacuum suctioning 162 (FIG. 3) to the cleaning head 150 via the vacuum hose 120. The housing 106 may further include a fluid injection unit 122 for injecting fluid 144 into the steam hose 114 for mixing with the steam 184 (FIGS. 3 and 6) that is provided to the cleaning head 150.

The fluid 144 of the fluid injection unit 122 may be provided in a composition that may promote or expedite the cleaning of the article 250 (FIG. 2) within the cleaning head 150. For example, the fluid 144 may comprise water, detergent, and/or chemicals for injection into the steam hose 114.

In an embodiment, the fluid 144 may comprise a composition for enhancing the cleaning of certain types of debris 258 (FIG. 2) or contaminants such as hydraulic fluids and greases. The fluid 144 (FIGS. 6 and 15B) may be injected into the steam 184 (FIGS. 6 and 15B) in the desired amount upon activation of a release valve 126 as described in greater detail below. The housing 106 may further include a waste receptacle 124 that may be coupled to the vacuum hose 120 for receiving steam 184, debris particles 260 (FIG. 15B), water vapor, detergent, chemicals, and other materials that may be suctioned from the vacuum chamber 160.

Figure 2:
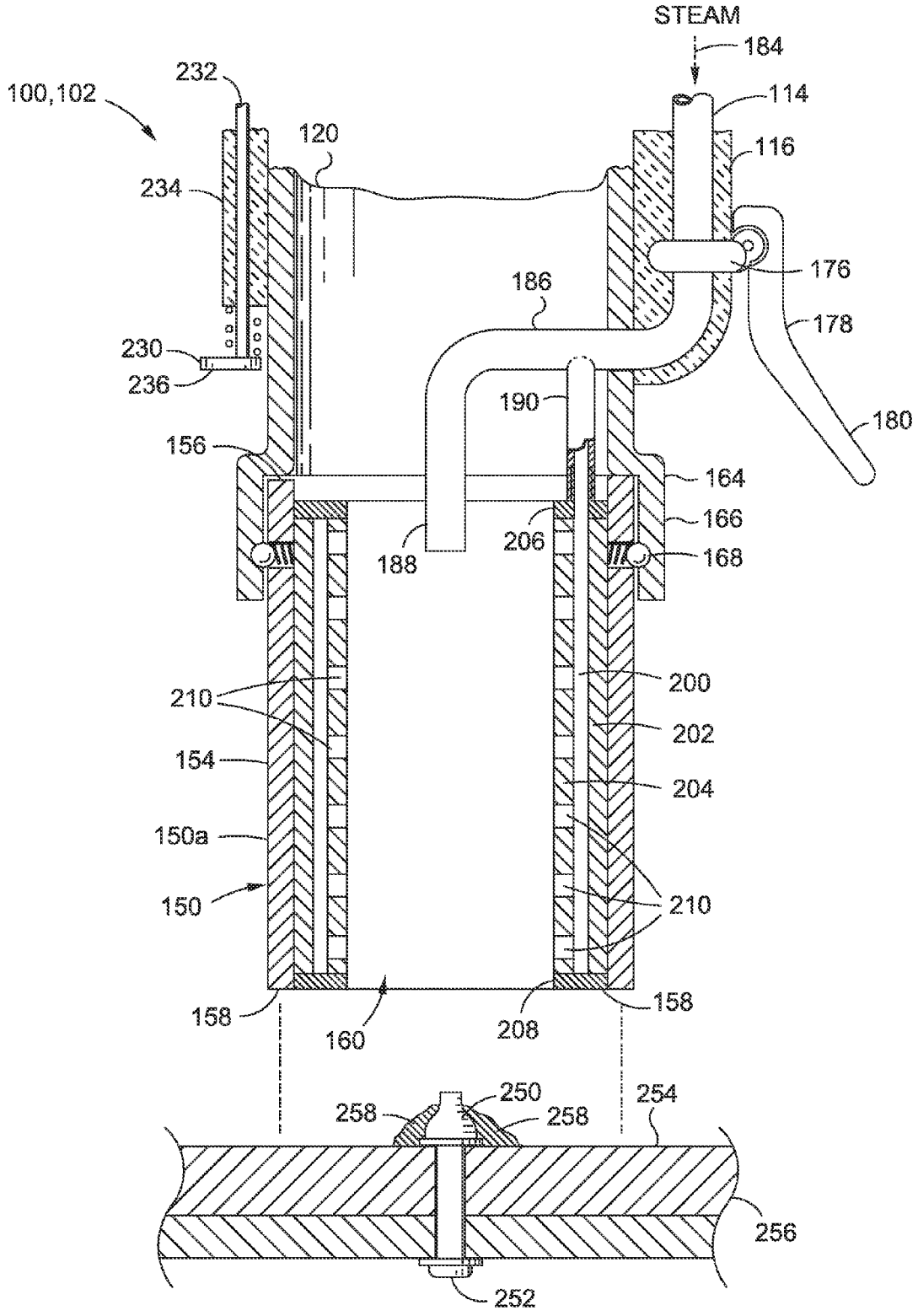
FIG. 2 is a cross sectional view of an embodiment of the cleaning head as may be implemented in the vacuum steam cleaning system.

Referring more particularly to FIGS. 2-3, shown is the cleaning head 150 and the annular steam chamber 200 enclosing the vacuum chamber 160. The cleaning head 150 may include a side wall 154. The cleaning head 150 (FIG. 2) may have an upper edge 156 and a lower edge 158. The side wall 154 may be coupled to the vacuum hose 120 (FIG. 2). For example, in an embodiment, the side wall 154 may be detachably coupled to an end fitting 164 the may be included with either the side wall 154 or the vacuum hose 120. In the embodiment shown, the end fitting 164 may be formed as a circular flange 166 for mating with the upper edge 156 of the side wall 154. In order to facilitate detachment of the cleaning head 150 and replacement of a cleaning head 150 of the same or different configuration, the end fitting 164 may be provided as a quick release mechanism 168 such as a ball-detent arrangement although the quick release mechanism 168 may be provided in any one of a variety of alternative configurations for releasably attaching the cleaning head 150 to the vacuum hose 120. Advantageously, the detachable arrangement of the cleaning head 150 facilitates mounting of any one of a variety of cleaning heads 150 of different sizes, shapes, and configurations to correspond to a given cleaning application as described in greater detail below.

The annular steam chamber 200 may be defined by an inner wall 204 (FIG. 2) and an outer wall 202 and may be capped or closed off on opposite ends by an upper closeout 206 (FIG. 2) and a lower closeout 208. In an embodiment, the outer wall 202 (FIG. 3) of the annular steam chamber 200 may be attached to the side wall 154 (FIG. 3) of the cleaning head 150 such as by adhesively bonding and/or mechanically fastening. Alternatively, the outer wall 202 of the annular steam chamber 200 may be integrated into the side wall 154 of the cleaning head 150. Even further, the outer wall 202 may be omitted from the annular steam chamber 200 and the side wall 154 may function as the inner wall 204 for enclosing the annular steam chamber 200. The annular chamber and the side wall 154 of the cleaning head 150 may also be formed as a unitary structure.

The annular chamber and side wall 154 may be formed of any suitable metallic or non-metallic material or combination thereof. In an embodiment, the side wall 154 (FIG. 3) and the inner and outer wall 202 and upper and lower closeout 206, 208 (FIG. 2) may be formed of a polymeric material such as polyethylene, polystyrene or nylon. The polymeric material preferably has a hardness level that is less than the hardness of the mounting surface 254 (FIG. 2) upon which the lower edge 158 is placed such that damage to the mounting surface 254 may be avoided. The polymeric material also preferably has a relatively low coefficient of friction to facilitate sliding movement of the lower edge 158 (FIG. 2) along the mounting surface 254 without lifting the lower edge 158 from the surface which would otherwise allow debris 258, steam 184, and other material to escape from the vacuum chamber 160.

Referring to FIG. 3, steam 184 may be delivered to the annular steam chamber 200 by a nozzle side outlet 190 that may extend from the nozzle 186 to the upper closeout 206 of the annular steam chamber 200. Although a single nozzle side outlet 190 is shown, any number may be provided. For example, a plurality (not shown) of nozzle side outlets 190 may extend from the nozzle 186 to different locations around the circumference of the upper end of the annular steam chamber 200 to provide a more uniform distribution of steam into the annular steam chamber 200 which may result in a more uniform discharge of steam spray 212 from the apertures 210 into the vacuum chamber 160. Furthermore, although the nozzle side outlet 190 is illustrated as being fluidly coupled to the upper end of the annular steam chamber 200, one or more nozzle side outlets 190 (not shown) may be included to provide steam 184 to the annular steam chamber 200 at one or more vertical locations (not shown) along the annular steam chamber 200.

Figure 4:
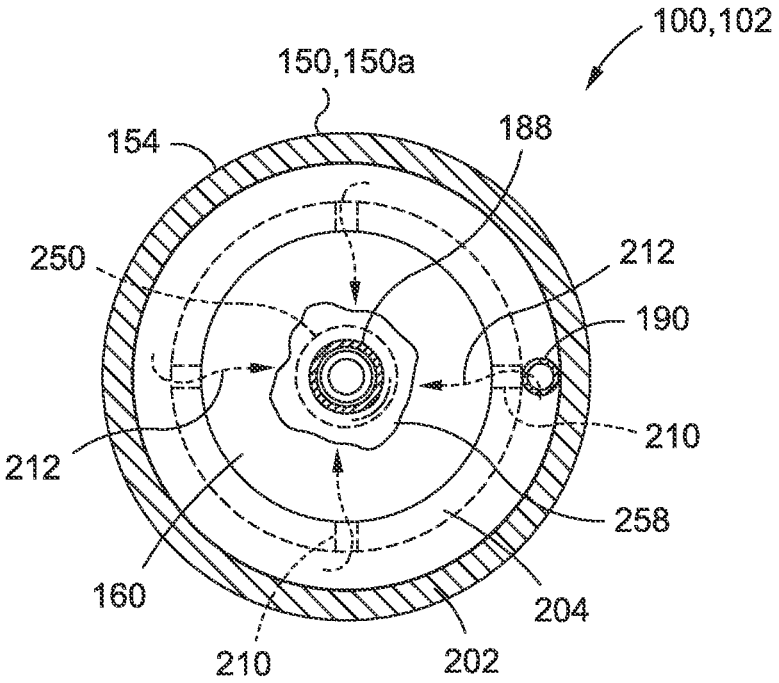
FIG. 4 is a cross sectional view of the cleaning head taken along line 4 of FIG. 3 and illustrating a nozzle main outlet and a nozzle side outlet for providing steam to the vacuum chamber.

Referring to FIG. 4, shown is a top cross sectional view of the cleaning head 150 illustrating the nozzle main outlet 188 and also illustrating the connection of the nozzle side outlet 190 to the annular steam chamber 200 at the upper closeout 206. As can be seen, the nozzle side outlet 190 may be connected to an upper end of the annular steam chamber 200. However, multiple nozzle side outlets 190 may be provided to more uniformly distribute steam 184 to the annular steam chamber 200.

Figure 5:
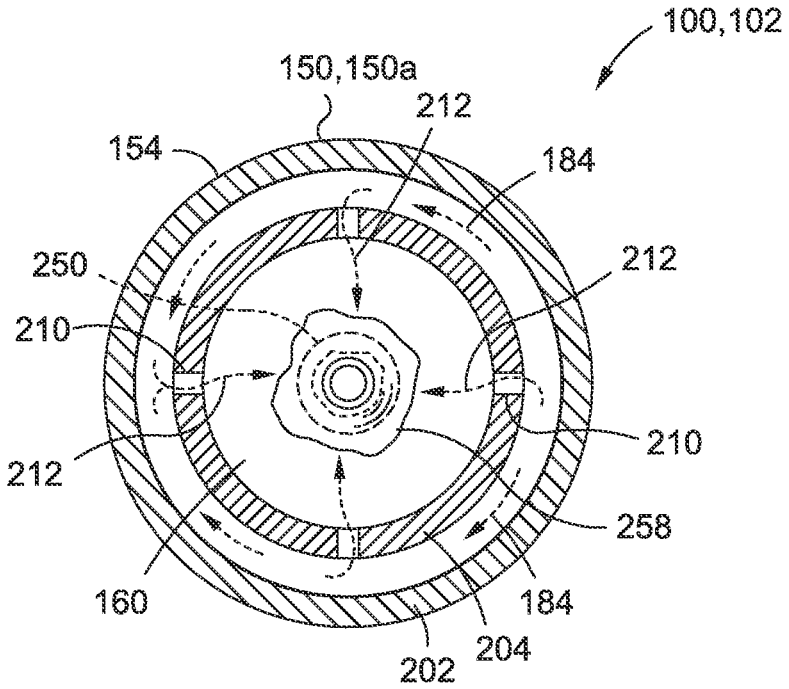
FIG. 5 is a cross sectional view of the cleaning head taken along line 5 of FIG. 3 and illustrating the flow of steam within the annular cavity and the discharge of the steam spray from the apertures.

Referring to FIG. 5, shown in a cross sectional view taken along a mid-height location of the annular steam chamber 200 and illustrating the flow of steam 184 along a circumferential direction through the annular steam chamber 200 to the plurality of apertures 210 formed in the inner wall 204. As shown in FIG. 2, the steam 184 may also flow along an axial direction or in other directions within the annular steam chamber 200. Although the annular steam chamber 200 is illustrated in FIGS. 3-5 as providing a generally unobstructed annular cavity, it is contemplated that the annular steam chamber 200 may be provided with passages (not shown) to direct the flow of steam 184 through the annular steam chamber 200. In addition, it is contemplated that the annular steam chamber 200 may be configured to provide a means for adjusting the opening and closing of certain apertures 210 to achieve a desired steam spray 212 pattern into the vacuum chamber 160 for a given cleaning application.

Although the apertures 210 are shown in FIGS. 3-5 as being positioned in generally equally spaced relation to one another along the inner wall 204, the apertures 210 may be positioned at any position or spacing in the axial direction (i.e., parallel to the longitudinal axis 152) and/or in the circumferential direction. Furthermore, the apertures 210 may be provided in any size, quantity, and orientation angle. For example, although FIGS. 3-5 illustrates each one of the apertures 210 (FIG. 3) as having a circular cross sectional shape, the apertures 210 may be provided in any cross sectional shape including an oval shape, an oblong shape, a slotted shape, or any one of a variety of other cross sectional shapes, without limitation. The apertures 210 may also be formed at the same size or in different sizes. Even further, the apertures 210 may be oriented at a non-perpendicular angle relative to the inner wall 204 (FIG. 4). For example, the apertures 210 shown in FIGS. 3-5 may be configured such that steam spray 212 is discharged into the vacuum chamber 160 along a generally laterally inward direction. However, one or more of the apertures 210 may be oriented at a non-perpendicular angle relative to the inner wall 204 such that steam spray 212 is directed along a predetermined direction such as along a downward direction toward the article 250 (FIG. 3) at the lower end of the cleaning head 150.

Advantageously, the apertures 210 (FIG. 3) may be configured to discharge steam spray 212 into the vacuum chamber 160 in a manner such that the surfaces of the article 250 may be exposed to the steam spray 212 for dislodging and removing debris 258 (FIG. 3), dirt, and unwanted material from the article 250 and surrounding area. In this regard, the aperture 210 size, quantity, location, relative position, orientation angle, distance of the apertures 210 from the article 250, and distance of the apertures 210 from the mounting surface 254 (FIG. 3) may be considered when sizing and configuring the cleaning head 150 (FIG. 4) for a given application. In this same regard, the overall size, shape, and configuration of the cleaning head 150 and annular steam chamber 200 may also be configured complementary to the size, shape, configuration, and quantity of articles 250 to be received and cleaned within the cleaning head 150.

Referring to FIG. 3, the cleaning head 150 may also include a nozzle main outlet 188 that may be configured to discharge steam spray 212 directly into the vacuum chamber 160. For example, the nozzle main outlet 188 may be configured to discharge steam spray 212 along a generally downward axial direction toward one or more articles 250 at the lower end of the cleaning head 150. However, the nozzle main outlet 188 may be configured to discharge steam spray 212 in any one of a variety of directions. Although FIG. 4 illustrates a single one of the nozzle main outlets 188 being generally centered within the vacuum chamber 160, the nozzle main outlet 188 may be provided in any quantity and in any size and location within the vacuum chamber 160. Even further, although shown in FIG. 3 as discharging steam spray 212 in a generally downward direction form the upper end of the vacuum chamber 160, the nozzle main outlet 188 may be oriented to discharge steam spray 212 at any angle within the vacuum chamber 160.

Advantageously, the cleaning head 150 (FIG. 3) may be configured such that the steam spray 212 that is discharged from the apertures 210 and/or from nozzle main outlet 188 results in the formation of a steam cloud 214 within the vacuum chamber 160. The steam cloud 214 may facilitate the removal of debris 258 (FIG. 3), contamination, and/or unwanted material from one or more surfaces of the article 250 (FIG. 3) and/or from the mounting surface 254 (FIG. 3) from which the article 250 may protrude. In an embodiment, the steam temperature and/or the steam pressure may be regulated or adjusted or otherwise controlled to correspond to a given application. For example, the steam temperature may be controlled at the housing 106 (FIG. 1) to provide steam 184 at a temperature that may avoid heat damage to the material composition of an article 250 and/or a mounting surface 254 being cleaned. The steam pressure may likewise be regulated by means of the steam valve 176 such that steam spray 212 (FIG. 4) may be discharged from the apertures 210 (FIG. 4) and/or from the nozzle main outlet 188 (FIG. 4) in a manner that the steam velocity is high enough to contact the article 250 prior to vacuum suctioning 162 of the steam 184 into the vacuum hose 120 (FIG. 3).

As indicated above, the steam 184 preferably promotes the dislodgement of debris 258 (FIG. 3) from the article 250 (FIG. 3) or mounting surface 254 (FIG. 3) by releasing and breaking up bonds between the debris 258 and the article 250 or the mounting surface 254. The breaking up of the debris 258 may result from a plurality of micro-explosions that may occur when relatively tiny hot water vapor molecules of steam 184 contact the relatively cooler debris 258. The micro-explosions may provide energy to break the bonds within the debris 258 and bonds between the debris 258 and the article 250 and/or mounting surface 254. The result of the micro-explosions and the breaking of the bonds is a plurality of relatively small debris particles 260 (FIG. 15B) that may become entrained in water suspension in the steam 184 cloud 214 (FIG. 3).

Figure 15B:
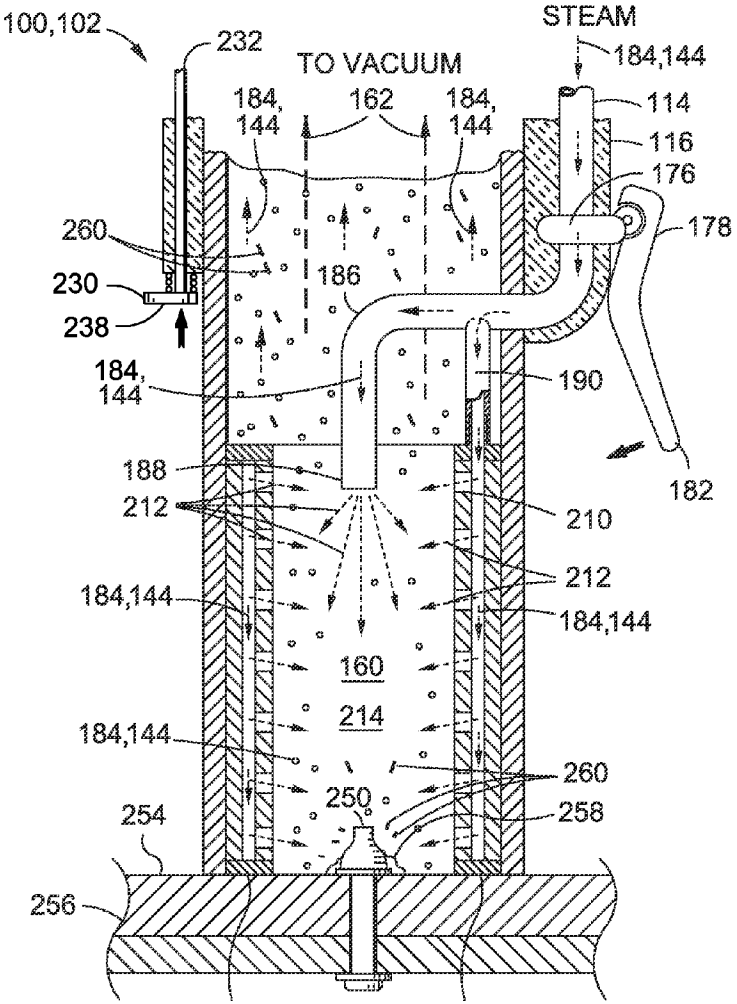
FIG. 15B is a cross sectional view of the cleaning head illustrating the discharge of steam spray into the vacuum chamber through the plurality of apertures and the dislodgement of contamination formerly covering the article and the mounting surface.

In an embodiment, the fluid injection unit 122 (FIG. 1) may inject fluid 144 (FIGS. 6 and 15B) such as detergent and/or chemicals (e.g., solvent) into the steam 184 (FIGS. 6 and 15B) which results in a mixture of molecules of detergent and chemicals in the steam cloud 214 (FIG. 15B). The mixture of detergent and chemical molecules in the steam cloud 214 may penetrate the relatively cooler debris 258 (FIG. 15B) covering an article 250 and may facilitate dislodgment of debris 258, dirt, and contamination covering the article 250 (FIG. 15B) and mounting surface 254 (FIG. 15B). Advantageously, the steam 184 may have a relatively low moisture content such as between approximately 2 percent and 10 percent moisture and, more preferably, between approximately 4 percent and 7 percent moisture which may enable the article 250 and/or mounting surface 254 to dry relatively quickly. Furthermore, the low moisture content of the steam 184 results in relatively low water usage during cleaning operations.

Referring to FIG. 3, the flow of steam 184 into the vacuum chamber 160 may be provided by the steam hose 114. In an embodiment, the steam hose 114 may extend along the vacuum hose 120 from the steam source 112 (FIG. 1) at the housing 106 (FIG. 1) to the cleaning head 150. Thermal insulation 116 may cover a substantial portion of the steam hose 114 to preserve the steam 184 temperature within the steam hose 114 and as a safety precaution for personnel using the vacuum steam cleaning system 100. The flow of steam 184 from the steam hose 114 into the nozzle 186 may be controlled by a steam valve 176 that may be mounted to the vacuum hose 120 and/or to the cleaning head 150.

The steam valve 176 may be controlled by a steam trigger 178 for selectively opening and closing the steam valve 176. The steam trigger 178 may also be configured for regulating the steam 184 flow rate into the vacuum chamber 160. In addition, the steam valve 176 may include a means for adjusting the pressure of the steam 184 flowing into the vacuum chamber 160 by adjusting the steam valve 176. In an embodiment, the steam trigger 178 may be pivotally mounted as a manually depressible lever. The steam trigger 178 may be biased to the closed position 180 (FIG. 8) as a safety precaution in the event the cleaning head 150 is dropped while steam spray 212 is discharging inside the vacuum chamber 160. Although shown as a lever, the steam trigger 178 may be provided in a variety of embodiments such as a switch, a push button, or other configurations for controlling the steam valve 176.

Referring still to FIG. 3, the cleaning head 150 may include a release switch 230 for controlling the release valve 126 of the fluid injection unit 122 mounted to the housing 106 in the embodiment of FIG. 1. When the release valve 126 is activated, the fluid injection unit 122 may inject an amount of selected fluid 144 (FIGS. 6 and 15B) into the steam hose 114 for mixing with the steam 184 prior to delivery to the cleaning head 150. Although the release switch 230 is shown as a single pushbutton device in FIG. 3, multiple release switches 230 may be provided corresponding to different types of fluid 144 to be injected into the steam hose 114 at any given time during cleaning operations.

For example, the fluid 144 may comprise water for increasing the capability of entraining and carrying debris particles 260 (FIG. 15B) out of the vacuum chamber 160 during vacuum suctioning 162.

As indicated above, the fluid 144 (FIGS. 6 and 15B) may also comprise detergent which may surround the debris particles 260 (FIG. 15B) once the particles 260 are broken loose from the article 250 (FIG. 3) and/or mounting surface 254 (FIG. 3). The detergent may encapsulate the debris particles 260 and prevent the debris particles 260 from re-attaching to one another and/or re-bonding to the article 250 or to the mounting surface 254. The fluid 144 may also comprise chemicals including, but not limited to, solvents for breaking up or dissolving certain type of debris 258 (FIG. 3) into smaller particles 260. In this regard, the fluid 144 may also comprise any one of a variety of other compositions, without limitation, for expediting or enhancing the cleaning of certain types of debris 258 or contaminants.

In FIG. 3, the release switch 230 is shown as a spring-loaded pushbutton attached to a cable 232. The pushbutton may be biased to the off position 236 by a biasing mechanism such as a coil spring (not shown) that may be mounted between the release switch 230 and the cable housing 234. The cable 232 may extend through a cable housing 234 mounted along the vacuum hose 120. The cable 232 may terminate at the quick release valve 126 (FIG. 1) at the housing 106 (FIG. 1). The release switch 230 shown in FIG. 2 is a non-limiting example of any one of a wide variety of switch configurations for regulating the release valve 126 of the fluid injection system 100. For example, the release switch 230 may comprise one or more electronic switches (not shown) that may be hardwired or wirelessly coupled to the release valve 126 at the housing 106.

Figure 6:
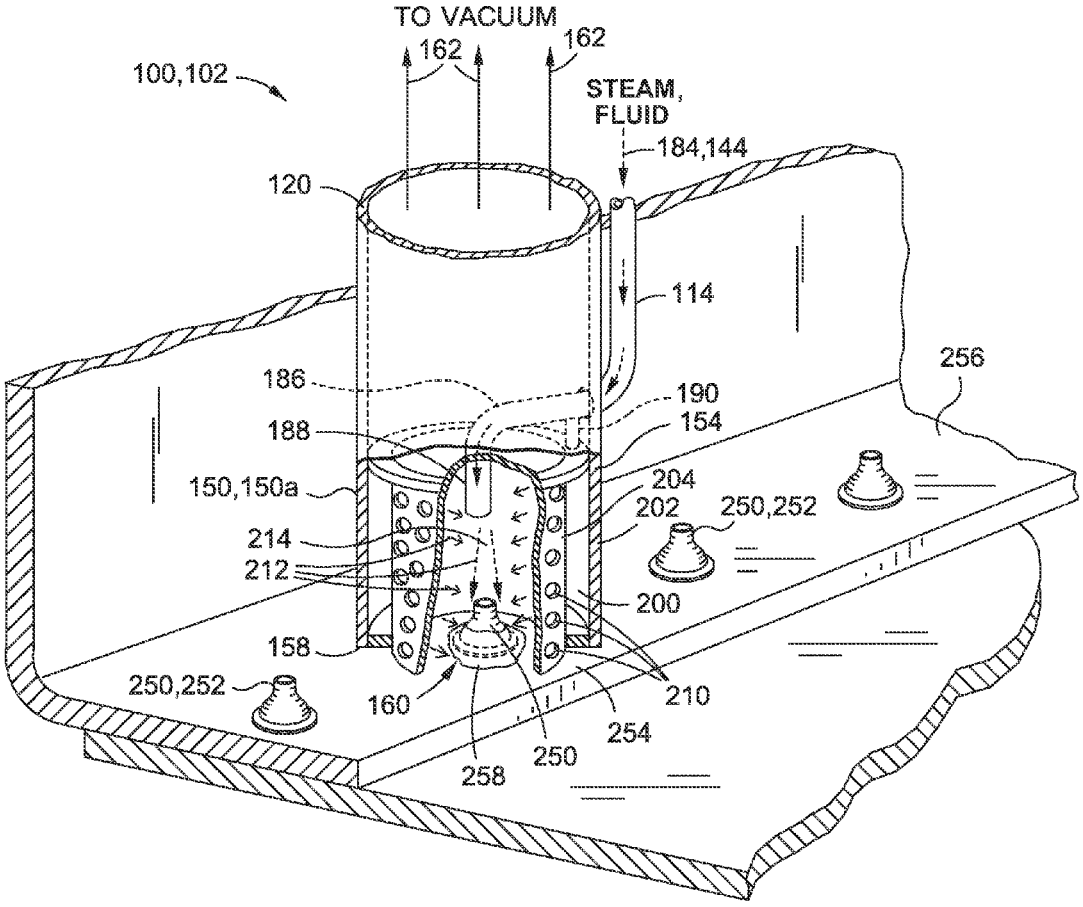
FIG. 6 is a perspective view of the cleaning head during vacuum steam cleaning of one of a series of fasteners protruding from a mounting surface.

Referring to FIG. 6, shown is the cleaning head 150 positioned over a fastener 252 protruding outwardly from the mounting surface 254 of a structure 256. Fluid 144 may be injected into the steam hose 114 for mixing with the steam 184 prior to delivery to the cleaning head 150. Steam 184 and fluid 144 may flow through the steam hose 114 and enter the nozzle 186 prior to passing through the apertures 210 and entering the vacuum chamber 160. The vacuum chamber 160 is preferably sized and configured to receive the fastener 252. The vacuum chamber 160 may also be sized to cover an area of debris 258 on the mounting surface 254 surrounding the fastener 252. In the embodiment shown, the lower edge 158 of the cleaning head 150 is preferably configured such that the vacuum chamber 160 is maintainable in substantially close contact with the mounting surface 254 when the article 250 is received within or covered by the vacuum chamber 160. In this regard, the perimeter of the lower edge 158 is preferably shaped complementary to the shape of the mounting surface 254 to prevent the escape of steam 184, debris 258, contamination, water, detergent, and/or chemicals from the vacuum chamber 160 when steam 184 is discharging inside the vacuum chamber 160.

Figure 7:
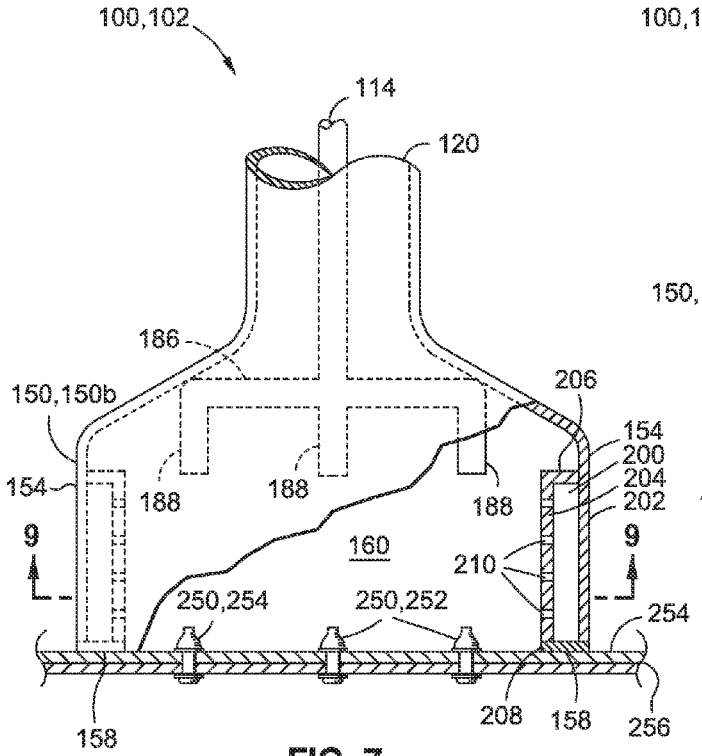
FIG. 7 is a side view of an alternative embodiment of the cleaning head having a generally oblong shape for cleaning a group of fasteners or other article(s)

Referring to FIG. 7, shown is a front view of an embodiment of the cleaning head 150*b* having a generally elongated cross sectional shape for simultaneously cleaning a group of articles 250 such as a group of fasteners 252? FIG. 7 illustrates the nozzle 186 having three individual nozzle main outlets 188 for discharging steam spray 212 (FIG. 3) directly into the vacuum chamber 160. However, any number of nozzle main outlets 188 may be provided.

Figure 8:
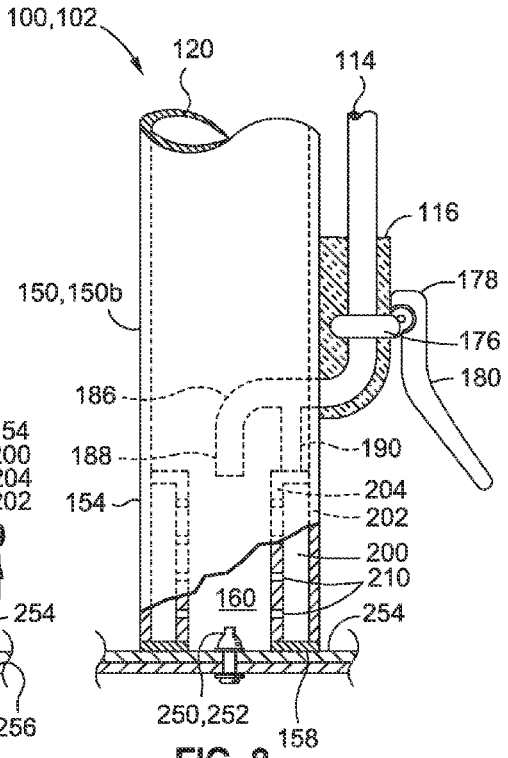
FIG. 8 is an end view of the cleaning head embodiment of FIG. 7.

FIG. 8 is a side view of the embodiment of the cleaning head 150*b* shown in FIG. 7 and illustrating the annular steam chamber 200 and the nozzle side outlet 190 for providing steam 184 into the annular steam chamber 200. However, as was mentioned above, multiple nozzle side outlets 190 may provide steam 184 (FIG. 6) to different locations at the upper end of the annular steam chamber 200. By including multiple nozzle side outlets 190, a more uniform distribution of steam 184 may be provided into the annular steam chamber 200 which may result in a more uniform distribution of steam spray 212 (FIG. 6) into the vacuum chamber 160.

Figure 9:
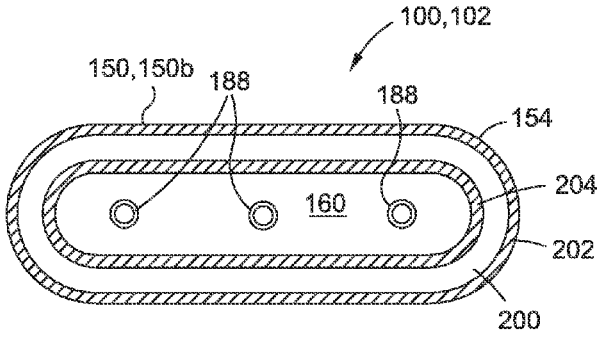
FIG. 9 is a cross sectional view of the cleaning head embodiment of FIG. 7.

FIG. 9 is a cross sectional view of the embodiment of the cleaning head 150*b* shown in FIG. 7 and illustrating the generally oblong cross sectional shape of the cleaning head 150*b* and the annular steam chamber 200. The annular steam chamber 200 may be defined by the inner wall 204 and the outer wall 202 which may also function as the side wall 154 of the cleaning head 150. The three individual nozzle main outlets 188 are shown generally uniformly distributed within the vacuum chamber 160 to provide a substantially uniform distribution of steam spray 212 (FIG. 6) directly into the vacuum chamber 160. Vacuum suctioning 162 (FIG. 6) may be provided by the vacuum hose 120 (FIG. 1) connected to the vacuum source 118 (FIG. 1). Although not shown, the cleaning system 100 may be configured to be removably detachable from the vacuum hose 120 such that a variety of different cleaning head 150 (FIG. 3) configurations can be mounted to the vacuum hose 120. FIGS. 7-9 are presented to illustrate that the cleaning head 150 may be provided in a wide variety of shapes, sizes, and configurations for receiving a plurality of articles 250 of any size, shape, and geometry.

Figure 10:
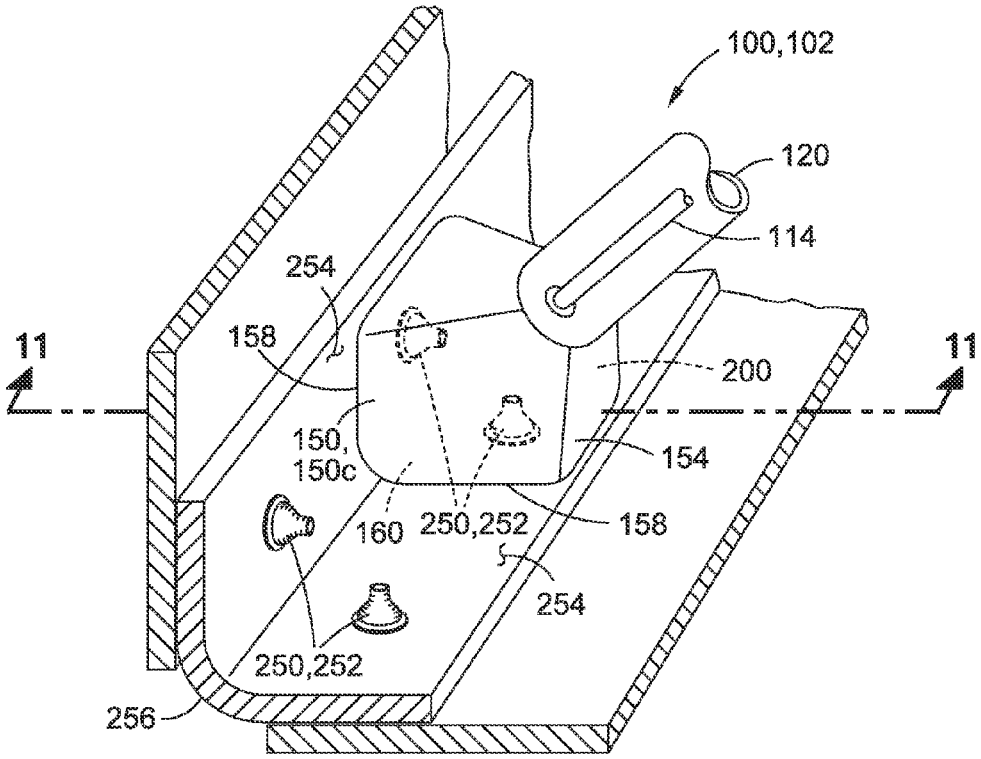
FIG. 10 is a perspective illustration of a further alternative embodiment of the cleaning head being formed complementary to a structure having multiple surfaces.
Figure 11:
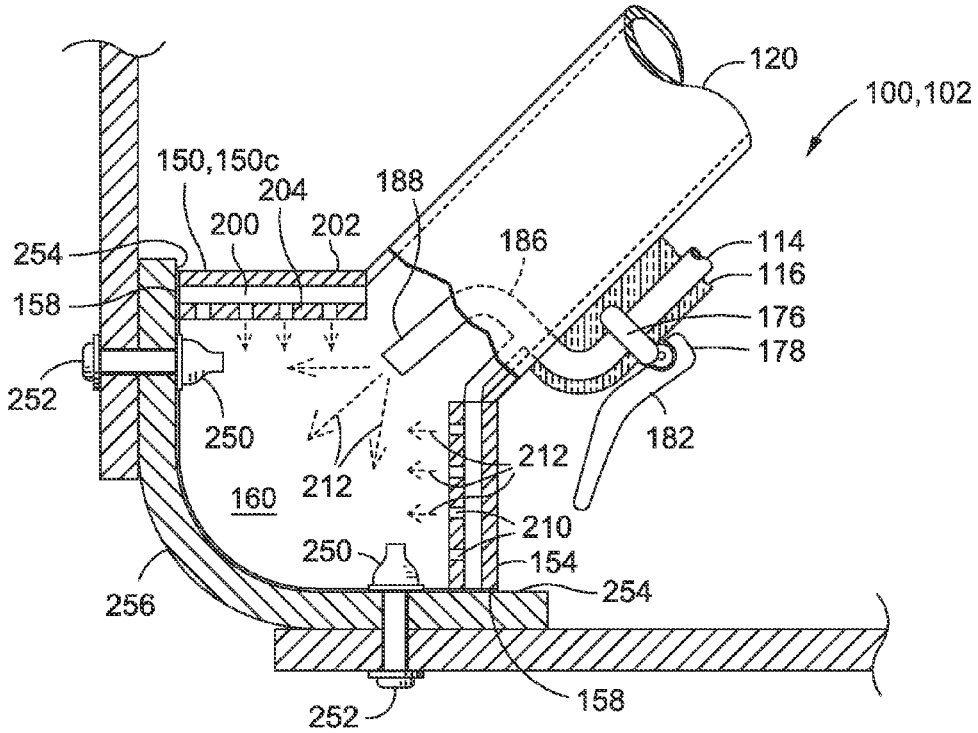
FIG. 11 is a cross section view of the cleaning head embodiment taken along line 11 of FIG. 10.

Referring to FIGS. 10-11, shown is a further embodiment of the cleaning head 150*c* having a wedge-shaped configuration for engagement with a structure 256 having two planes oriented at an angle relative to one another. The cleaning head 150 may be configured for cleaning two rows of fasteners 252 protruding through different mounting surfaces 254 of the structure 256. The cleaning head 150 in FIG. 10 is configured such that the lower edge 158 may be maintained in substantially sealed engagement with both of the mounting surfaces 254.

FIG. 11 illustrates the discharge of steam spray 212 into the vacuum chamber 160 during activation of the steam trigger 178. The vacuum chamber 160 is preferably configured to generate a steam cloud 214 that may envelope both of the fasteners 252 while vacuum suctioning 162 the vacuum chamber 160 to facilitate removal of debris 258 (not shown). Although not shown, the cleaning head 150 in FIGS. 10-11 may be configured to be detachably removable such that the vacuum steam cleaning system 100 may be used to clean different geometries. FIGS. 10-11 are presented to illustrate that the cleaning head 150 is configurable in different shapes for engaging with non-planar surfaces and cleaning multiple articles 250 within a single three-dimensional space defined by the vacuum chamber 160 (FIG. 10). In this regard, the lower edge 158 (FIG. 11) of the cleaning head 150 and/or annular steam chamber 200 may be configured to be complementary to any one of a wide variety of mounting surface 254 geometries including generally planar shapes, non-planar shape, complex curved shapes, and any combination thereof.

Figure 12:
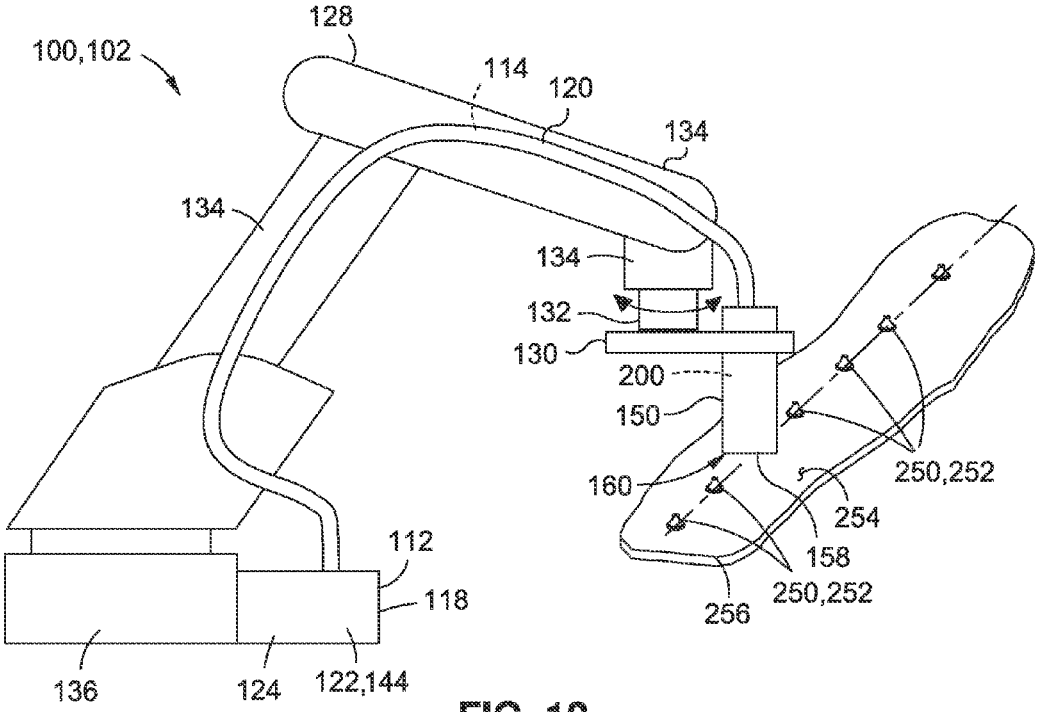
FIG. 12 is a schematic illustration of a robotic assembly having the cleaning head mounted on an end effector for performing autonomous cleaning of one or more articles and/or mounting surfaces.
Figure 13:
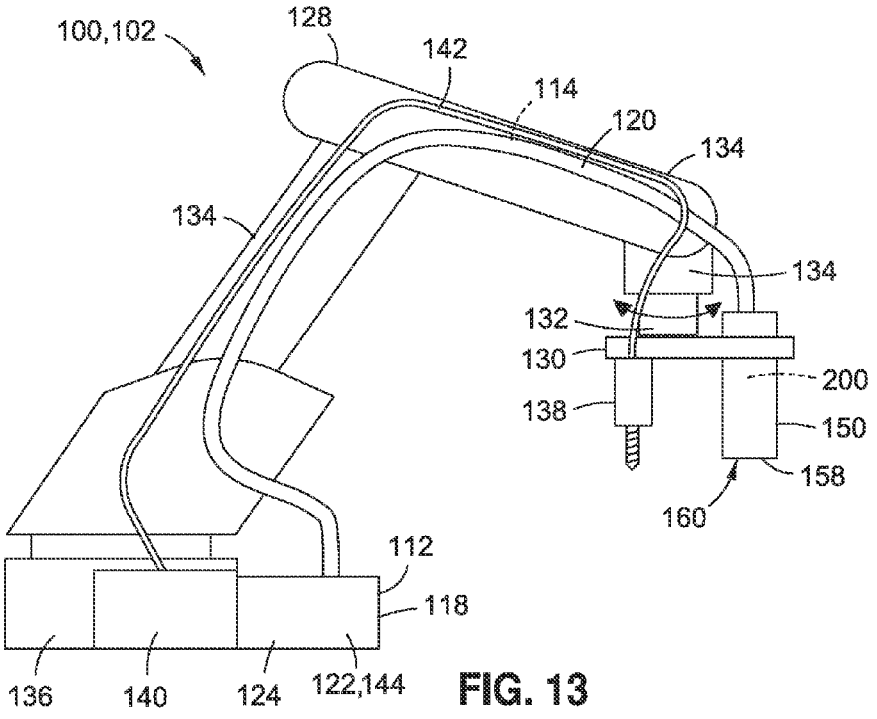
FIG. 13 is a schematic illustration of a further embodiment of the robotic assembly having a manufacturing device mounted adjacent to the cleaning head on a rotary joint of the end effector.

Referring to FIGS. 12-13, shown is the vacuum steam cleaning system 100 incorporated into a robotic assembly 128 for automated or semi-automated cleaning of one or more articles 250. In the embodiment shown, the cleaning head 150 may be mounted to an end effector 130. The end effector 130 may be mounted to a movable joint located on an end of a robotic arm 134 of the robotic assembly 128. The movable joint may facilitate positioning of the cleaning head 150 in a desired position and orientation of the cleaning head 150 for engaging a mounting surface 254 and cleaning one or more articles 250. For example, the movable joint may comprise a rotary joint 132 for positioning the cleaning head 150 during sequential cleaning of a row of fasteners 252 protruding from a mounting surface 254 of a structure 256.

A vacuum hose 120 may extend from the cleaning head 150 to a vacuum source 118 that may be mounted to a base 136 of the robotic assembly 128. Likewise, a steam hose 114 may extend from the cleaning head 150 to the steam source 112 at the base 136. A fluid injection unit 122 and a waste receptacle 124 may be included in the base 136 to provide the functions described above with regard to the housing 106 illustrated in FIG. 1. The steam trigger 178 and the release switch 230 described above and shown in FIG. 3 may be omitted from the robotic assembly 128 as control of steam 184 from the steam source 112 and fluid 144 (FIGS. 6 and 15B) from the fluid injection unit 122 may be preprogrammed into the robotic assembly 128.

FIG. 13 is an illustration of a further embodiment of the robotic assembly 128 wherein one or more manufacturing devices 138 may be mounted on the end effector 130. For example, the manufacturing device 138 may comprise a device for performing operations on a structure 256 (FIG. 12). In one or more embodiments, the manufacturing device 138 may include one or more devices for machining, drilling, painting, sealing, imaging, testing, inspecting, sensing, and other operations. The manufacturing device 138 may be coupled via a supply line 142 to a power supply/material supply unit 140 at the base 136 of the robotic assembly 128 for delivery of materials and/or power to the manufacturing device 138. For example, the supply line 142 may deliver lubricant, sealant, coating material, or other materials to the manufacturing device 138. The supply line 142 may also deliver electrical power, pressurized air, hydraulic fluid, and other mediums for operating the manufacturing device 138. The cleaning head 150 may be employed in the robotic assembly 128 to perform vacuum steam 184 cleaning operation on the structure 256 prior to or following the performance of one or more manufacturing, inspection, repair, or maintenance operations on the structure 256 by one or more of the manufacturing devices 138.

Figure 14:
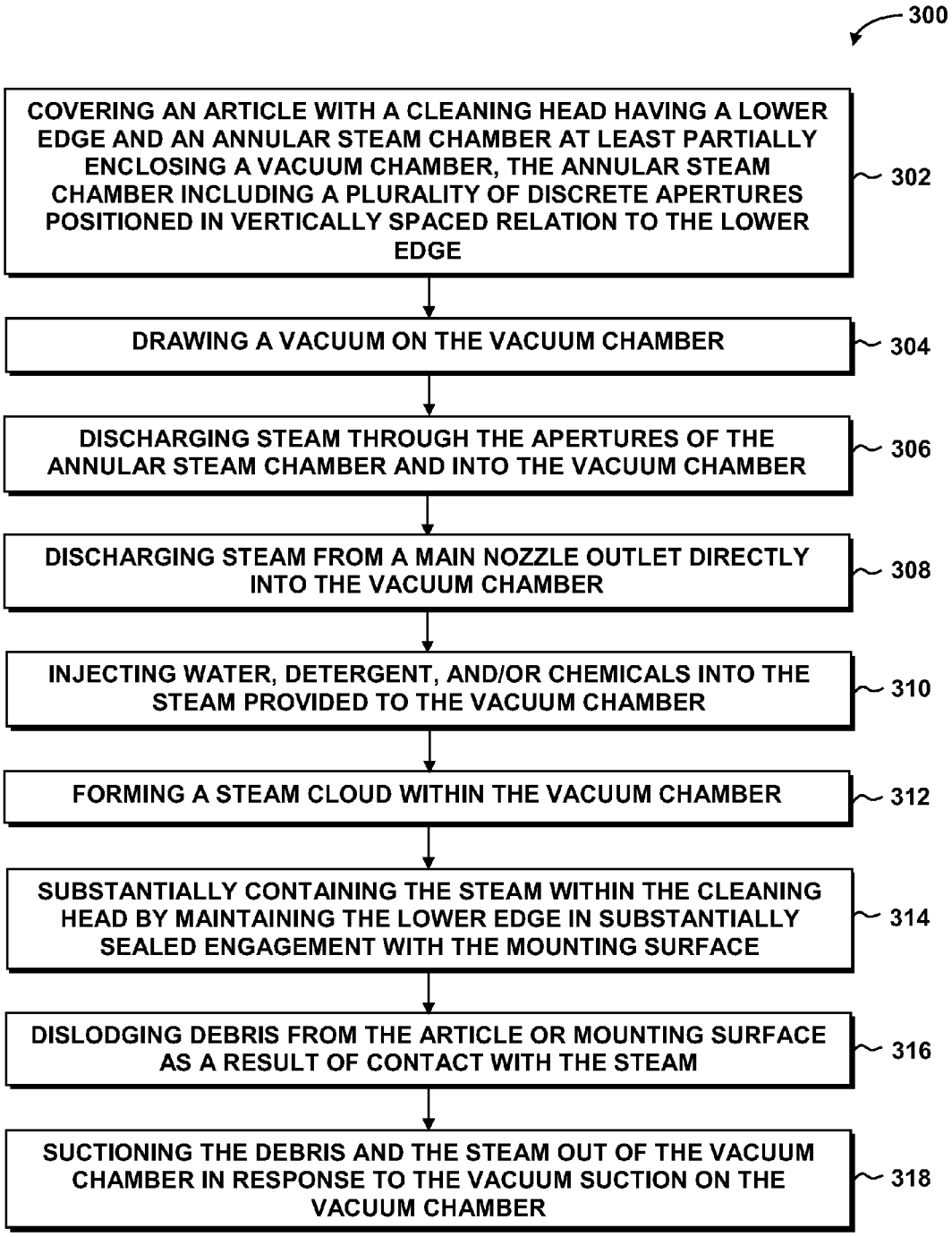
FIG. 14 is a flow chart illustrating one or more operations that may be included in a method for cleaning an article and/or a mounting surface.

Referring to FIG. 14 with additional reference to FIGS. 15A-15D, shown in FIG. 14 are one or more steps or operations that may be included in a method 300 of cleaning an article 250.

Figure 15A:
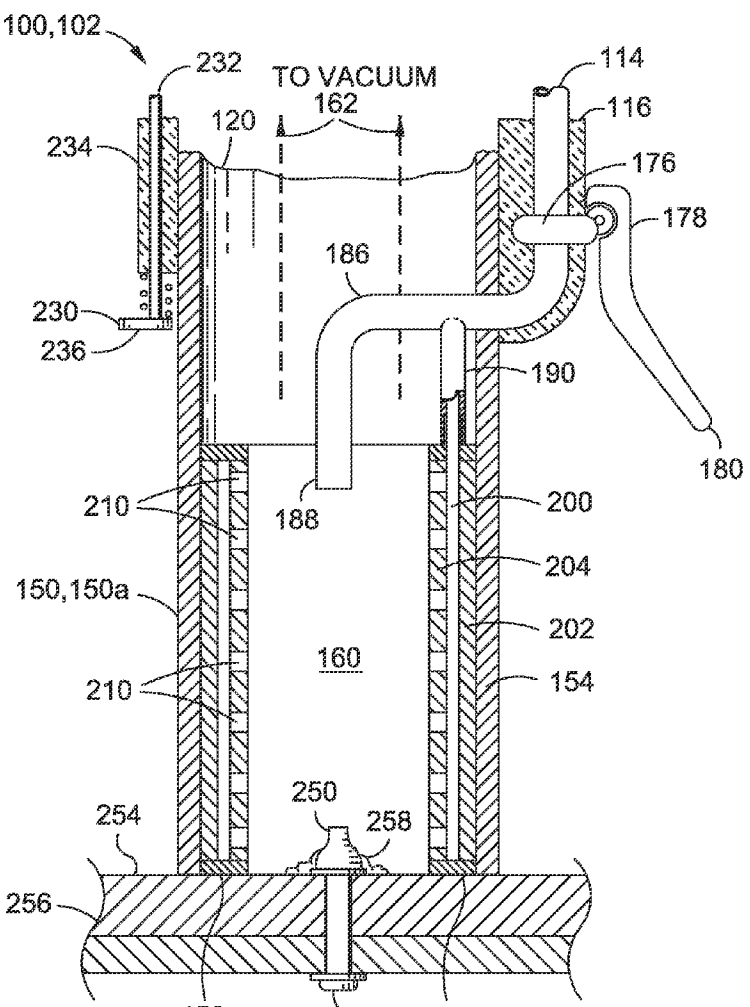
FIG. 15A is a cross sectional view of the cleaning head covering a fastener protruding from a mounting surface and illustrating a vacuum drawn on the vacuum chamber.

Step 302 of the method 300 of FIG. 14 may include covering an article 250 with a cleaning head 150. For example, FIG. 15A illustrates the lower edge 158 of the cleaning head 150 engaged to the mounting surface 254 such that the fastener 252 is enclosed within the vacuum chamber 160. The steam trigger 178 may be moved to the closed position 180 to prevent steam 184 from entering the vacuum chamber 160.

Step 304 of the method 300 of FIG. 14 may include activating the vacuum source 118 and drawing at least a partial vacuum on the vacuum chamber 160 (FIG. 15A) prior to opening the steam valve 176 (FIG. 15A) as a means to prevent injury or damage that may otherwise occur if high temperature steam were provided to the vacuum chamber 160 without first drawing a vacuum on the vacuum chamber 160. Alternatively, for certain applications, it may be desirable to activate the steam trigger 178 (FIG. 15A) prior to activating the vacuum chamber 160 such that high temperature steam fills the vacuum chamber 160 to increase the debris-loosening capability of the steam 184 against certain types of debris 258 (FIG. 15A). In this regard, the lower edge 158 (FIG. 15A) of the cleaning head 150 may be placed in substantially sealing engagement with the mounting surface 254 (FIG. 15A) prior to opening the steam valve 176.

Step 306 of the method 300 of FIG. 14 may include moving the steam trigger 178 to the open position 182 as shown in FIG. 15B and allowing steam 184 to flow into the nozzle 186 and discharge through the apertures 210 into the vacuum chamber 160. The steam spray 212 may be discharged from the apertures 210 at a predetermined angle which may be dictated in part by the angular orientation of the apertures 210 as described above. In this regard, the orientation of the apertures 210 may be configured complementary to the height and geometry of the article 250 to be cleaned.

Step 308 of the method 300 of FIG. 14 may include discharging steam spray 212 from a nozzle main outlet 188 directly into the vacuum chamber 160. FIG. 15B illustrates steam spray 212 exiting the nozzle main outlet 188 along a direction generally toward the location of the article 250 and the mounting surface 254 at the lower end of the vacuum chamber 160. However, the nozzle 186 may be configured to direct steam spray 212 from the nozzle main outlet 188 at any angle relative to the vacuum chamber 160. The steam valve 176 may be manipulated to regulate the flow rate of steam 184 into the vacuum chamber 160 by using the steam trigger 178. One or more temperature sensors (not shown) may be included with the cleaning head 150 to sense the temperature within the vacuum chamber 160 and facilitate manual or autonomous adjustment of the temperature and/or flow rate of steam 184 into the vacuum chamber 160 to avoid overheating the article 250.

Step 310 of the method 300 of FIG. 14 may include injecting one or more fluids 144 (FIG. 15B) into the steam 184 (FIG. 15B) flowing toward the vacuum chamber 160. As indicated above, the fluid 144 may comprise water, detergent, chemicals, or other compositions to expedite the cleaning process. Activation of the fluid injection unit 122 (FIG. 1) may be achieved by moving the release switch 230 to the on position 238 as shown in FIG. 15B. The release switch 230 may be coupled to the release valve 126 (FIG. 1) on the housing 106 (FIG. 1) and may cause the injection of one or more types of fluid 144 into the steam hose 114.

Step 312 of the method 300 of FIG. 14 may include forming a steam cloud 214 within the vacuum chamber 160 as shown in FIG. 15B. The steam cloud 214 may engulf or substantially surround and contact the article 250 and the mounting surface 254 to be cleaned. In this manner, the steam cloud 214 may facilitate the removal of debris 258 (FIG. 15A) or contamination from one or more surfaces of the article 250 as described above.

Step 314 of the method 300 of FIG. 14 may include maintaining the lower edge 158 of the cleaning head 150 in substantially sealed engagement with the mounting surface 254 as shown in FIG. 15B. The lower edge 158 is preferably configured or shaped complementary to the shape of the mounting surface(s) 254. The sealing engagement of the cleaning head 150 to the mounting surface(s) 254 may substantially contain the contaminated steam, dislodged debris particles 260, water vapor, chemicals, detergents, and other materials within the vacuum chamber 160 and prevent the release thereof into the surrounding environment.

Step 316 of the method 300 of FIG. 14 may include the dislodgement of debris 258 (FIG. 15A) from the article 250 (FIG. 15A) or from the mounting surface 254 (FIG. 15A) from which the article 250 protrudes. The dislodgement of debris 258 may be effected by breaking the bonds between the debris 258 and the article 250 or between the debris 258 and the mounting surface 254 in a manner described above. The breaking of the bonds may result from micro-explosions that may occur when the relatively tiny hot water vapor molecules of steam 184 contact the relatively cooler debris 258. In this manner, the debris 258 may be broken up into a plurality of relatively small debris particles 260 as shown in FIGS. 15B-15C. The small debris particles 260 may then become entrained in water suspension in the steam cloud 214. The release switch 230 may be moved to the off position 236 (FIG. 15A) to halt the injection of fluid 144 into the steam hose 114 after the debris 258 is broken up into debris particles 260.

Figure 15D:
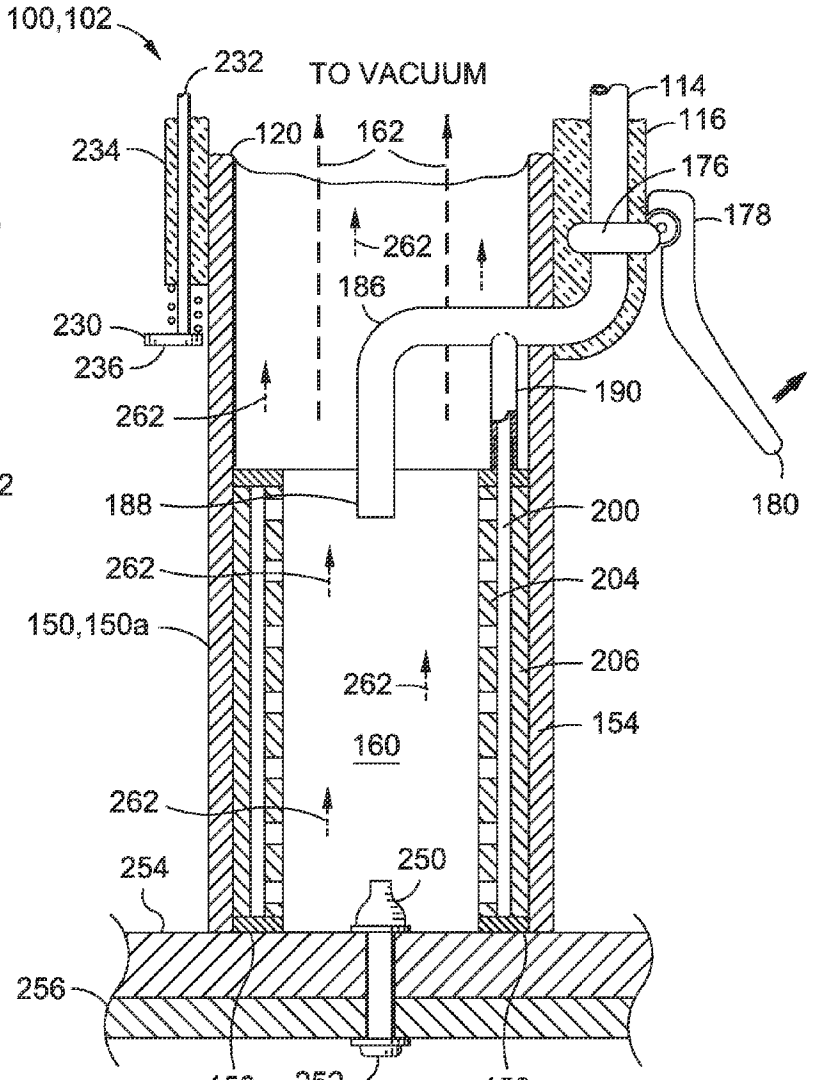
FIG. 15D is a cross sectional view of the cleaning head illustrating the halting of steam into the vacuum chamber and the suctioning of the leftover steam from the vacuum chamber.
Figure 15C:
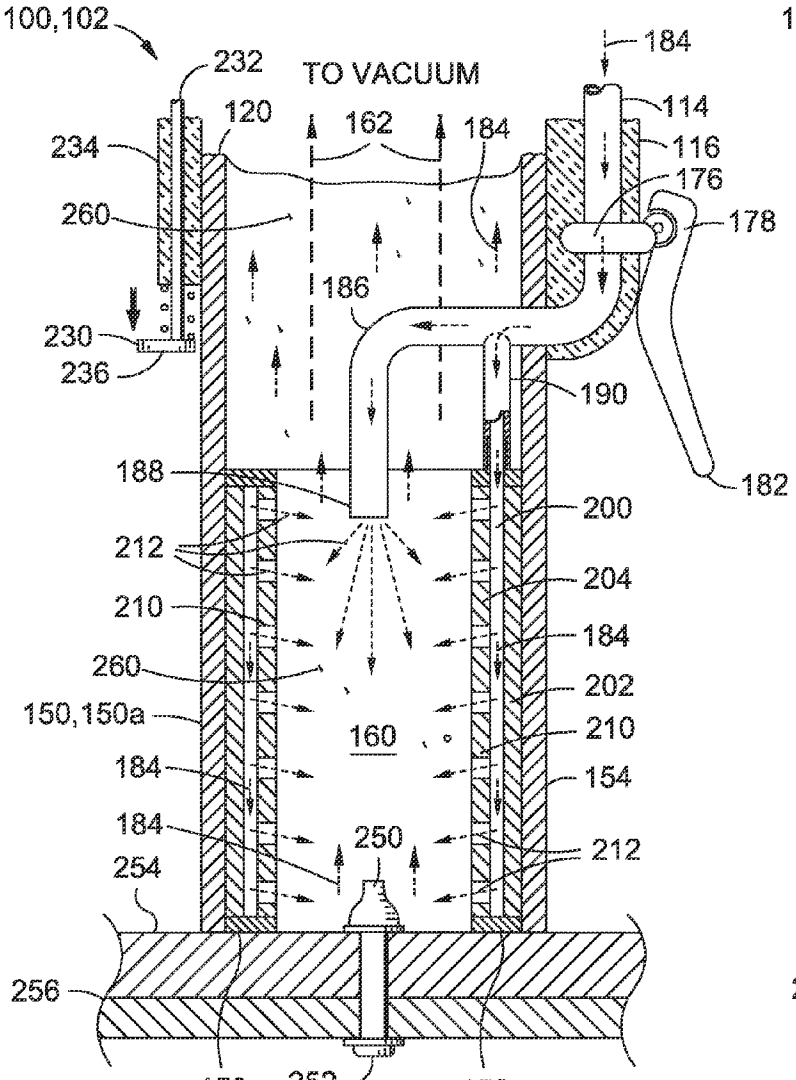
FIG. 15C is a cross sectional view of the cleaning head illustrating the suctioning of debris particles and steam from the vacuum chamber.

Step 320 of the method 300 of FIG. 14 may include vacuum suctioning 162 the debris particles 260 and the steam 184 out of the vacuum chamber 160 as shown in FIGS. 15C and 15D. The vacuum suctioning 162 may draw the debris particles 260 (FIG. 15B) into the vacuum hose 120 and ultimately into the waste receptacle 124 (FIG. 1) at the housing 106 (FIG. 1). In FIG. 15D, the steam trigger 178 may be released to stop the flow of steam 184 into the vacuum chamber 160. The vacuum suctioning 162 may be continued until a substantial majority of the debris particles 260 and any leftover steam 262 is drawn out of the vacuum chamber 160.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting or exhaustive. Although specific terms are employed herein, they are used in a generic and descriptive sense only and not for purposes of limitation.

What is claimed is:

1. A method of cleaning, comprising:

providing a cleaning head having a plurality of apertures in an inner wall of the cleaning head, the cleaning head having an annular steam chamber open at a lower edge of the cleaning head and enclosing a vacuum chamber, the apertures fluidly coupling the annular steam chamber to the vacuum chamber and being located in vertically spaced relation to the lower edge of the cleaning head; and providing a steam nozzle fluidly coupled to the annular steam chamber.

2. The method of claim 1, further comprising:

fluidly coupling an upper end of the annular steam chamber to the steam nozzle.

3. The method of claim 1, further comprising:

providing at least one nozzle main outlet coupled to the steam nozzle.

4. The method of claim 3, further comprising:

configuring the nozzle main outlet to discharge steam spray along a downward direction toward a lower end of the cleaning head.

5. The method of claim 1, wherein:

the apertures are arranged around a circumference of the annular steam chamber.

6. The method of claim 1, wherein:

the apertures are provided in at least one of the following cross-sectional shapes: a round shape, an oval shape, an oblong shape, a slotted shape.

7. The method of claim 1, further comprising:

mounting a steam valve to the cleaning head and coupled to the steam nozzle for regulating a flow of steam into the vacuum chamber.

8. The method of claim 7, further including:

positioning a steam trigger with the steam valve.

9. The method of claim 7, wherein:

the steam valve regulating steam velocity discharged from the apertures and into the vacuum chamber.

10. The method of claim 1, further including:

directing a flow of steam through a passage in the annular steam chamber.

11. The method of claim 1, further including:

controlling an injection of fluid into the steam chamber.

12. The method of claim 1, further comprising:

fluidly coupling the cleaning head to a vacuum hose for suctioning steam from the vacuum chamber.

13. The method of claim 12, wherein the step of fluidly coupling the cleaning head to a vacuum hose includes:

releasably coupling the cleaning head to the vacuum hose using a quick release mechanism.

14. The method of claim 1, further comprising:

providing the annular steam chamber and a side wall of the cleaning head as a unitary structure.

15. The method of claim 1, wherein:

one or more portions of the cleaning head are formed from polymeric material.

16. The method of claim 1, further comprising:

coupling the cleaning head to a fluid injection unit.

17. The method of claim 1, further comprising:

providing a housing including at least one of the following:

a steam hose coupling a steam source to the cleaning head;

a fluid injection unit for containing fluid for injection into the steam hose;

a vacuum hose coupling a vacuum source to the cleaning head; and a waste receptacle coupled to the vacuum hose for receiving at least one of steam and debris.

18. The method of claim 1, further comprising:

mounting the cleaning head on an end effector of a robotic assembly.

19. The method of claim 18, further comprising:

mounting the end effector to a movable joint located on an end of a robotic arm of the robotic assembly.

20. A method of cleaning, comprising:

providing a cleaning head having a plurality of apertures in an inner wall of the cleaning head, the cleaning head having an annular steam chamber open at a lower edge of the cleaning head and enclosing a vacuum chamber, the apertures fluidly coupling the annular steam chamber to the vacuum chamber and being located in vertically spaced relation to the lower edge of the cleaning head;

fluidly coupling an upper end of the annular steam chamber to a steam nozzle; and fluidly coupling at least one nozzle main outlet to the steam nozzle.

* * * * *